US006299557B1

(12) United States Patent
Mueller

(10) Patent No.: US 6,299,557 B1
(45) **Date of Patent: *Oct. 9, 2001**

(54) RACKET GRIPPING DEVICE

(76) Inventor: Edward Mueller, 1009 NW. 107th Ave., Pembroke Pines, FL (US) 33026

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/199,981

(22) Filed: Nov. 23, 1998

Related U.S. Application Data

(63) Continuation-in-part of application No. 08/921,073, filed on Aug. 29, 1997.

(51) Int. Cl.[7] ..... A63B 49/00
(52) U.S. Cl. ..... 473/553; 473/518; 473/549
(58) Field of Search ..... 473/518, 549, 473/551, 553, 201, 205, 266

(56) References Cited

U.S. PATENT DOCUMENTS

| | | | |
|---|---|---|---|
| 482,647 | * | 9/1892 | Ober . |
| 739,450 | * | 9/1903 | Schnek . |
| 2,476,489 | * | 7/1949 | Grandinetti . |
| 3,255,462 | * | 6/1966 | Antonious . |
| 3,693,973 | | 9/1972 | Wattenberg . |
| 3,712,618 | | 1/1973 | Berzatu . |
| 3,858,881 | * | 1/1975 | Hurwitz . |
| 3,868,110 | | 2/1975 | Jones . |
| 3,957,267 | * | 5/1976 | Vitalo . |
| 4,057,255 | * | 11/1977 | Bishop . |
| 4,209,169 | * | 6/1980 | Roberts . |
| 4,226,418 | | 10/1980 | Balfoar . |
| 4,265,448 | * | 5/1981 | Anderson . |
| 4,322,077 | | 3/1982 | Van't Hof . |
| 4,664,381 | | 5/1987 | Aaron . |
| 4,684,559 | * | 8/1987 | Wasko . |
| 4,836,544 | | 6/1989 | Lai . |
| 4,943,058 | | 7/1990 | Corbonetti . |
| 4,962,929 | * | 10/1990 | Melton . |
| 5,018,734 | | 5/1991 | Allsoy . |
| 5,257,782 | | 11/1993 | Schicketanz . |
| 5,459,883 | | 10/1995 | Garceau . |
| 5,472,190 | | 12/1995 | Norling . |
| 5,476,257 | | 12/1995 | Bobby . |
| 5,593,353 | * | 1/1997 | Kramer . |
| 5,771,500 | * | 6/1998 | Mayes . |
| 5,899,872 | * | 5/1999 | Gilmour . |
| 5,901,379 | * | 5/1999 | Hirata . |
| 5,913,757 | * | 6/1999 | Winters . |
| 5,946,737 | * | 9/1999 | Fleege . |
| 5,957,141 | * | 9/1998 | Elkins . |

* cited by examiner

*Primary Examiner*—Benjamin H. Layno
*Assistant Examiner*—Vishu Mendiratta
(74) *Attorney, Agent, or Firm*—Rene Martin Oliveras

(57) ABSTRACT

The present invention relates to a device for use in gripping tennis rackets or the like which is of durable construction and which is easy to use, reliable, and efficient in operation. This device assists a tennis player, pro or novice, to maintain a proper grip on the handle of a tennis racket. This device is constructed of a single unitary piece which includes a wristband being attachable together by fastening means such as "Velcro" (a trademark) or other known hook and loop means, and a handle gripping extension which jutaxposes from the center of the wristband and is slidably attachable to the racket handle via a hole or opening on the extension. This device is made of lightweight material and does not add perceptible weight to the tennis racket or to the user's wrist. The user wears the device to improve his game performance without discomfort or interference with his concentration.

13 Claims, 7 Drawing Sheets

RACKET GRIPPING DEVICE

PRIOR APPLICATIONS

This is a continuation in part application of application Ser. No. 08/921,073, filed Aug. 29, 1997 entitled "Racket Gripping Device" by Edward Mueller, which prior application is to be abandoned.

FIELD AND BACKGROUND OF THE INVENTION

This invention relates to a device for use in conjunction with a tennis racket or the like. More specifically, this invention relates to a device for firmly gripping a tennis racket for training and strengthening a user's performance. This invention assists a tennis player, pro or novice, to maintain a proper grip on the handle of a tennis racket. More particularly, this device positions the racket handle at an angle of from 90 degrees to 120 degrees relative to the user's wrist. This device may be made of a single unitary structure which comprises a wristband attachable together by fastening means such as "Velcro" (a trademark) or other known hook and loop means, and a handle gripping strap which jutaxposes from the center of the wristband and is slidably attachable to the handle. This device is made of lightweight material which does not add perceptible weight to the racket or to the user's wrist. This allows the user to wear the device to improve his game performance without discomfort or interference with his concentration.

DESCRIPTION OF THE PRIOR ART

There are several known prior art devices for gripping rackets. Both novice and advanced tennis players often develop the habit of improperly gripping a tennis racket, which habit is difficult to overcome and which can lead to sprains and Injuries. Various prior art devices have been proposed as useful to increase a player's grip on a tennis racket including those described in the following patents:

Wattenberg U.S. Pat. No. 3,693,973 discloses a cuff member adapted to be strapped tightly about a user's forearm;

Berzatzy U.S. Pat. No. 3,712,618 discloses a rigid wrist/hand brace which is attached to a tennis racket handle;

Hurwitz U.S. Pat. Nos. 3,858,881; Roberts 4,209,169; and Bobby 5,476,257 disclose devices in which a band or strap is placed around the player's forearm which is in turn connected to a cord or strap tied to the racket;

Jones U.S. Pat. No. 3,868,110 discloses a detachable grip for a tennis handle which is molded with finger and hand indentations accommodating positions of the hand for different strokes;

Vitalo U.S. Pat. No. 3,957,267 discloses a wrist loop, at least two elongated loops, and quick release fastener means for a baseball bat;

Balfour U.S. Pat. No. 4,226,418, discloses a hand grip for a racket handle with a textured surface for the thumb and hand and a web with holes for engagement by the fingers of the hand;

Van't Hof U.S. Pat. No. 4,322,073 discloses a wrist band including a flexible strap, a sleeve, a face plate, and 2 beads;

Aaron U.S. Pat. Nos. 4,664,381; Lai 4,830,544; and Carbonetti 4,943,058 disclose anatomical grips for tennis rackets;

Allsop U.S. Pat. No. 5,018,734 discloses a handle grip with a lever to locate the user's hand about the handle;

Schicketanz U.S. Pat. No. 5,257,782 discloses a racket grip having a pair of arms which retain and bear against the rear surfaces of the hand adjacent to the thumb and heel portions of the hand;

Garceau U.S. Pat. No. 5,459,883 discloses a hand cover/grip enhancer including a panel, a restraining loop or band, an anchor strap, a retaining band, and an elastic tensioning band;

Norling U.S. Pat. No. 5,472,190 discloses a "cage" that is secured to the racket handle and into which the player inserts his hand to grip the racket handle.

None of the above cited prior art devices appear to anticipate or makes obvious the present single piece device which grips a tennis racket handle or similar sporting racket handle at an action of from 90 degrees to 120 degrees relative to the user's wrist/forearm. Certain disadvantages experienced with such prior art devices are obviated by the racket gripping device disclosed herein. Although useful for their own purposes, such prior art devices do not appear to disclose the racket gripping device disclosed herein.

OBJECTS OF THE INVENTION

Objects of the present invention are therefore to provide:

an improved gripping device for a racket handle which overcomes some of the above-mentioned disadvantages of the prior art devices;

an improved, lightweight, single piece gripping device for sports (tennis, squash, etc.) racket handles;

a racket gripping device which aids in training of tennis players and in strengthening their game;

racket gripping device that will reduce the occurrence of injuries during tennis training.

Other objects, advantages and features of the racket gripping device disclosed herein will become readily apparent to those skilled in the art from the following detailed description when considered in conjunction with the attached drawings.

BRIEF DESCRIPTION OF THE DRAWINGS

The racket gripping device of the present invention will now be described with reference to the embodiments thereof as illustrated in the accompanying drawings in which.

DETAILED DESCRIPTION OF THE INVENTION

Figure 1:
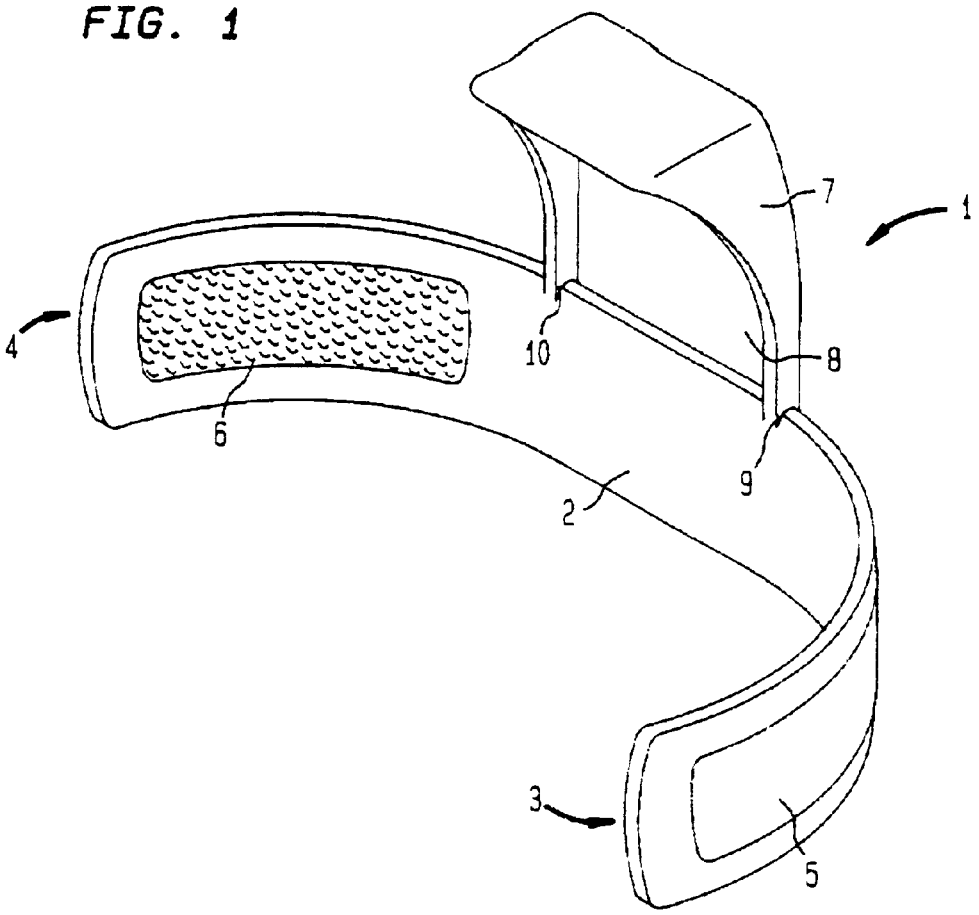
FIG. 1 is an isometric view of a first embodiment of the present invention.

FIG. 1 is an isometric view of racket gripping device 1 showing body 2, first end or edge 3, second end or edge 4, first fastening means 5 on the rear surface of body 2, second fastening means 6 on the front surface of body 2, extension 7, aperture or hole 8 formed by extension 7, first connection point 9, and second connection point 10.

Figure 2:
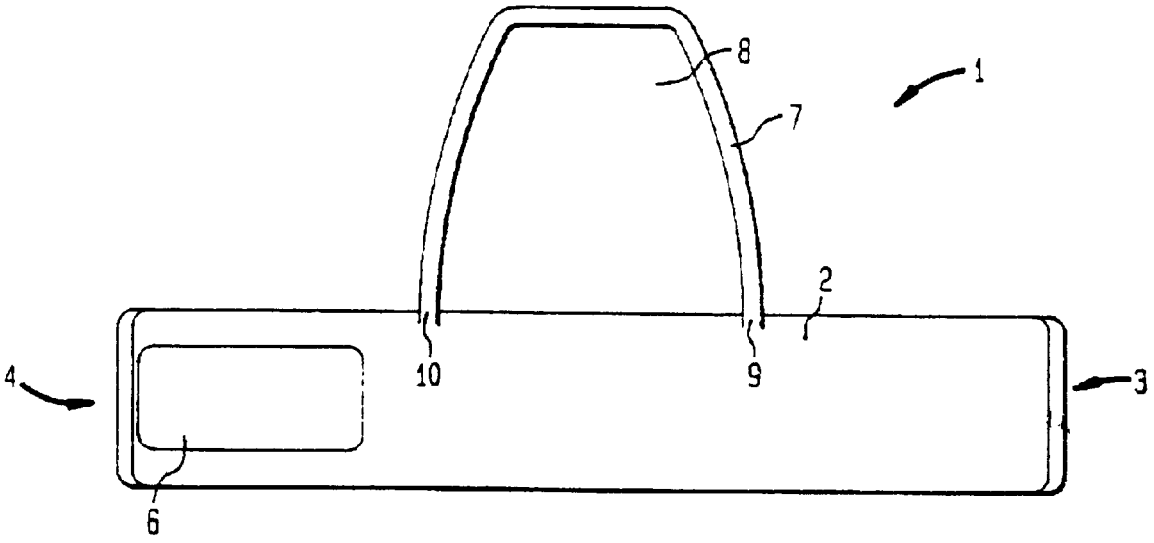
FIG. 2 is a front view of said first embodiment.

FIG. 2 is a front view of racket gripping device 1 showing body 2, first end or edge 3, second end or edge 4, second fastening means 6 on the front surface of body 2, extension 7, aperture or hole 8 formed by extension 7, first connection point 9, and second connection point 10.

Figure 3:
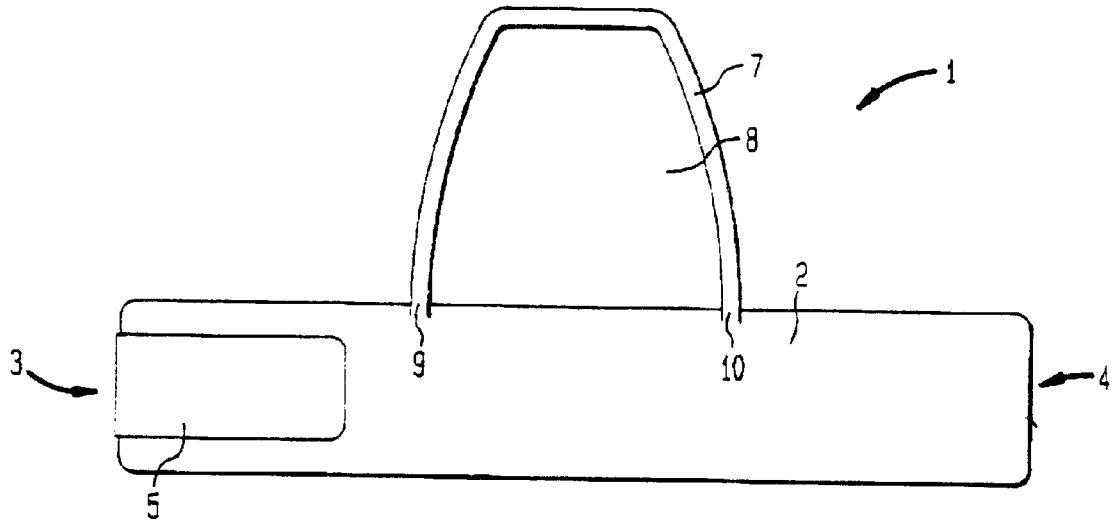
FIG. 3 is a rear view of said first embodiment.

FIG. 3 is a rear view of racket gripping device 1 showing body 2, first end or edge 3, second end or edge 4, first fastening means 5 on the rear surface of body 2, extension 7, aperture or hole 8 formed by extension 7, first connection point 9, and second connection point 10.

Figure 4:
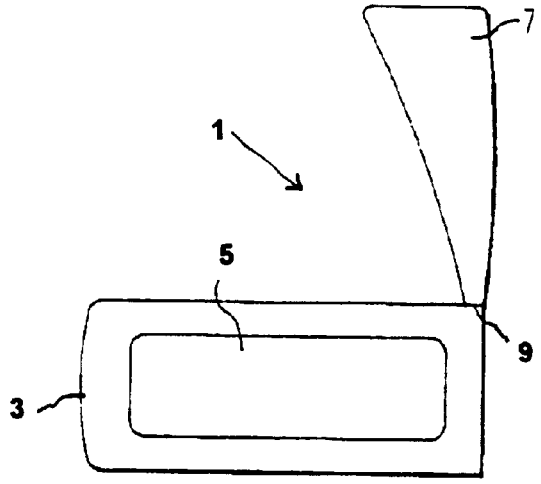
FIG. 4 Is a right view of said first embodiment.

FIG. 4 is a right view of racket gripping device 1 showing first end or edge 3, first fastening means 5 on the rear surface of body 2, extension 7, and first connection point 9.

Figure 5:
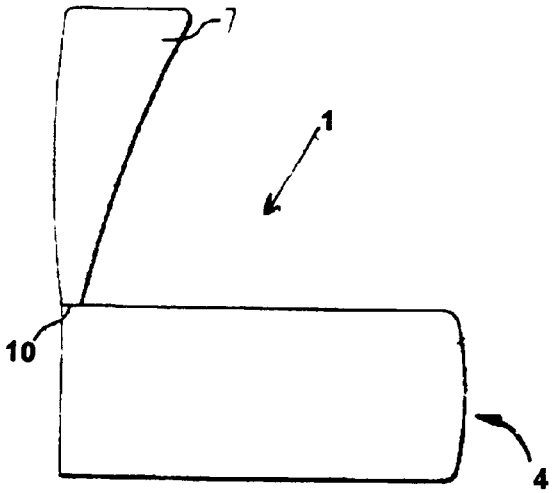
FIG. 5 is a left view of said first embodiment.

FIG. 5 is a left view of racket gripping device 1 showing second end or edge 4, extension 7, and second connection point 10.

Figure 6:
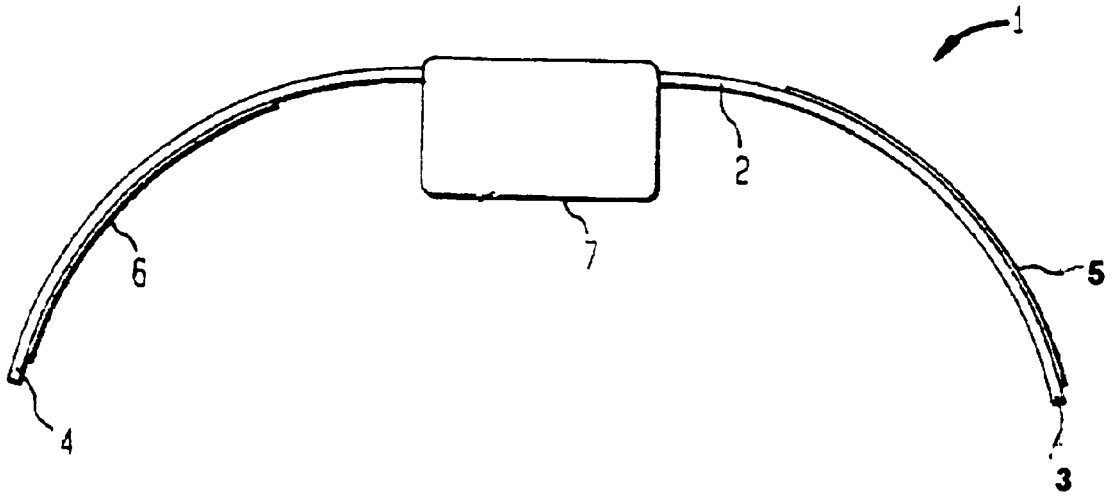
FIG. 6 is a top view of said first embodiment.

FIG. 6 is a top view of racket gripping device 1 showing body 2, first end or edge 3, second end or edge 4, first fastening means 5 on the rear surface of body 2, second fastening means 6 on the front surface of body 2, and extension 7.

Figure 7:
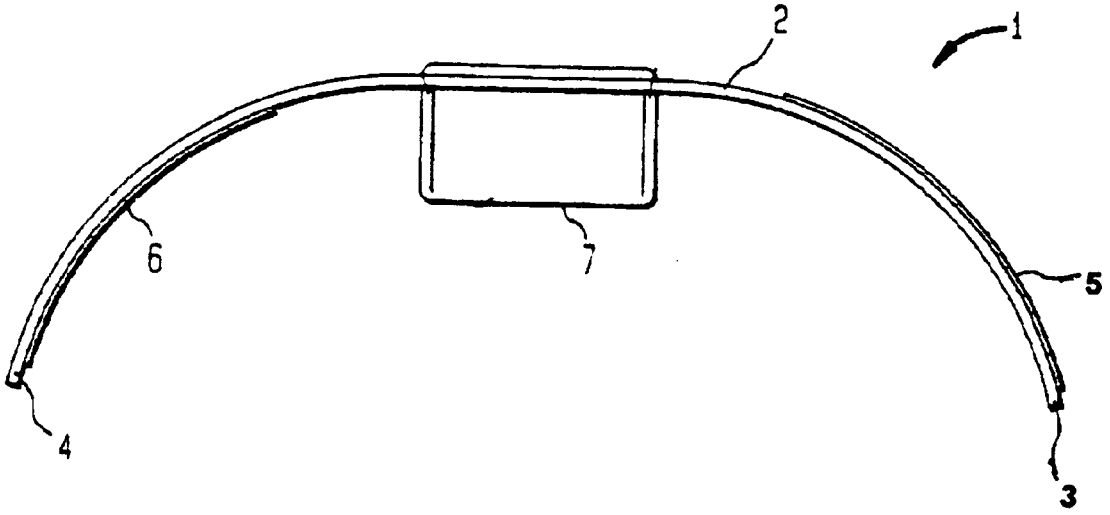
FIG. 7 is a bottom view of said first embodiment.

FIG. 7 is a bottom view of racket gripping device 1 showing body 2, first end or edge 3, second end or edge 4, first fastening means 5 on the rear surface of body 2, second fastening means 6 on the front surface of body 2, and extension 7.

Figure 8:
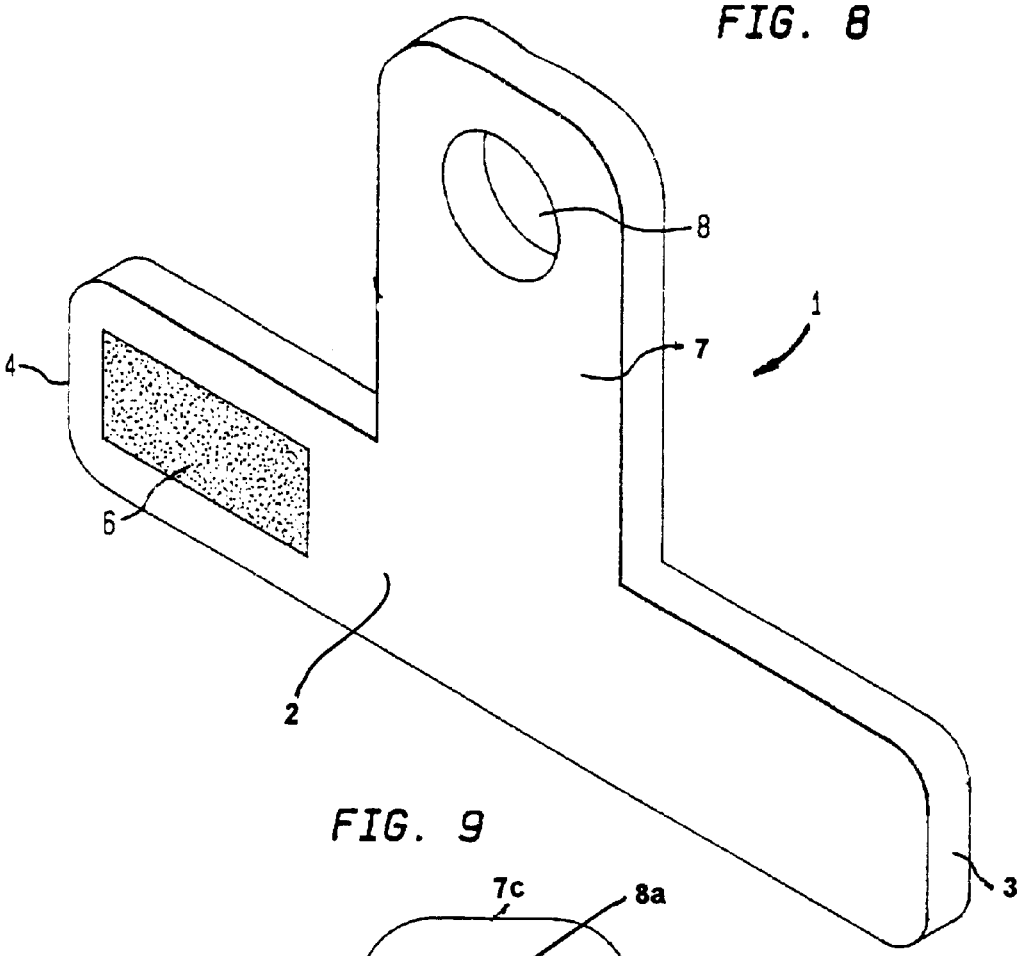
FIG. 8 is an isometric view of a second embodiment of the present invention.

FIG. 8 is an isometric view of racket gripping device 1 showing body 2, first end or edge 3, second end or edge 4, second fastening means 6 on the front surface of body 2, extension 7, and aperture or hole 8 on extension 7.

Figure 9:
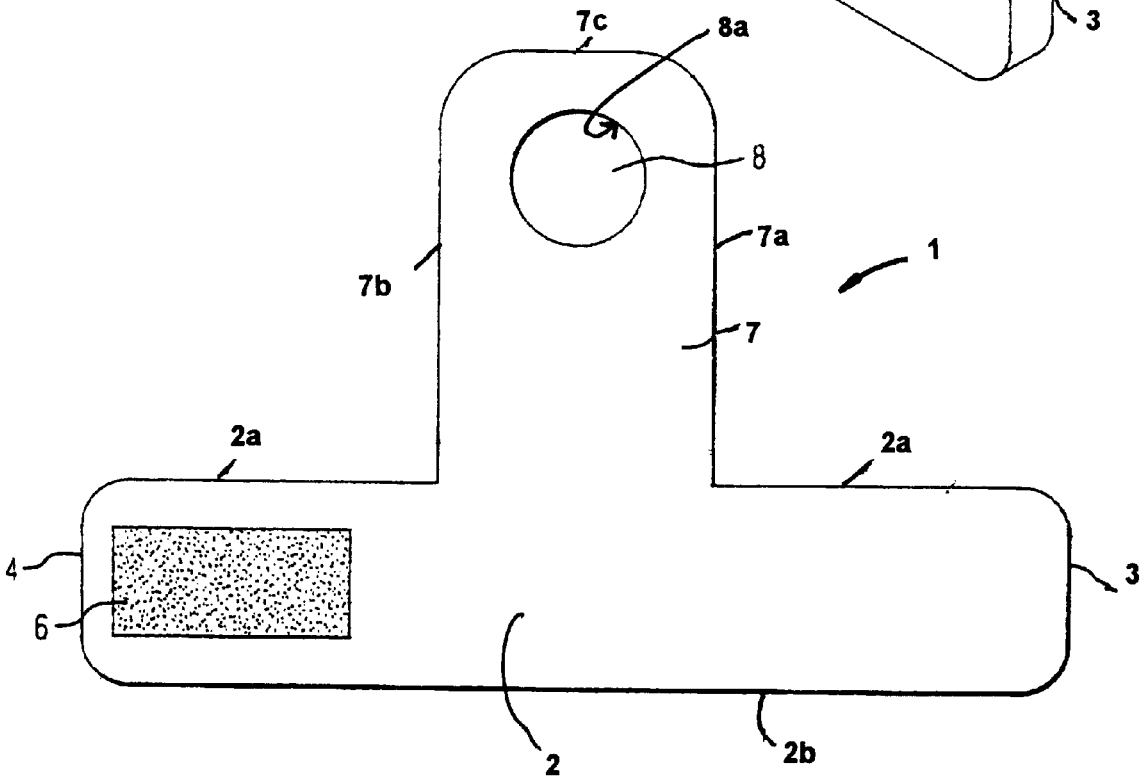
FIG. 9 is a front view of said second embodiment.

FIG. 9 is a front view of racket gripping device 1 showing body 2, first end or edge 3, second end or edge 4, second fastening means 6 on the front surface of body 2, extension 7, and aperture or hole 8 on extension 7. In FIG. 9 a horizontal line connecting first end 3 and second end 4 defines the horizontal axis of body 2.

Figure 10:
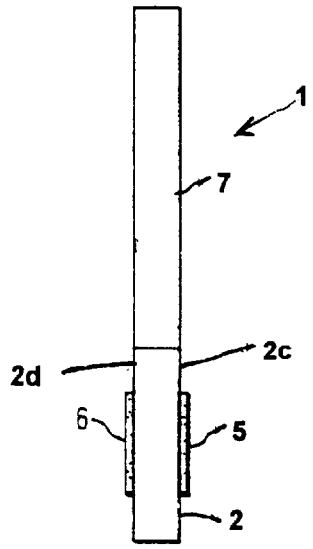
FIG. 10 is a side view of said second embodiment.

FIG. 10 is a side view of racket gripping device 1 showing body 2, first fastening means 5 on the rear surface of body 2, second fastening means 6 on the front surface of body 2, and extension 7.

Figure 11:
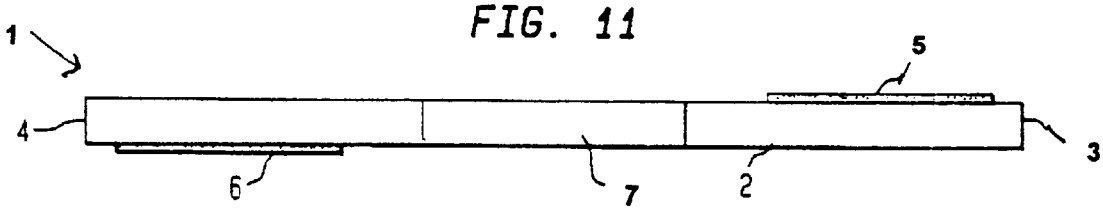
FIG. 11 is a top view of said second embodiment.

FIG. 11 is a top view of racket gripping device 1 showing body 2, first end or edge 3, second end or edge 4, first fastening means 5 on the rear surface of body 2, second fastening means 6 on the front surface of body 2, and extension 7.

Figure 12:
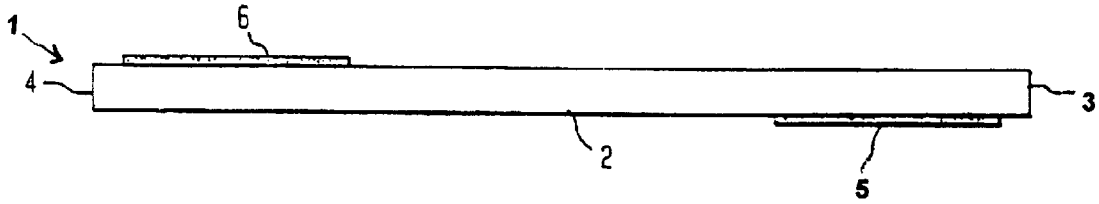
FIG. 12 is a bottom view of said second embodiment.

FIG. 12 is a bottom view of racket gripping device 1 showing body 2, first end or edge 3, second end or edge 4, first fastening means 5 on the rear surface of body 2, and second fastening means 6 on the front surface of body 2.

Figure 13:
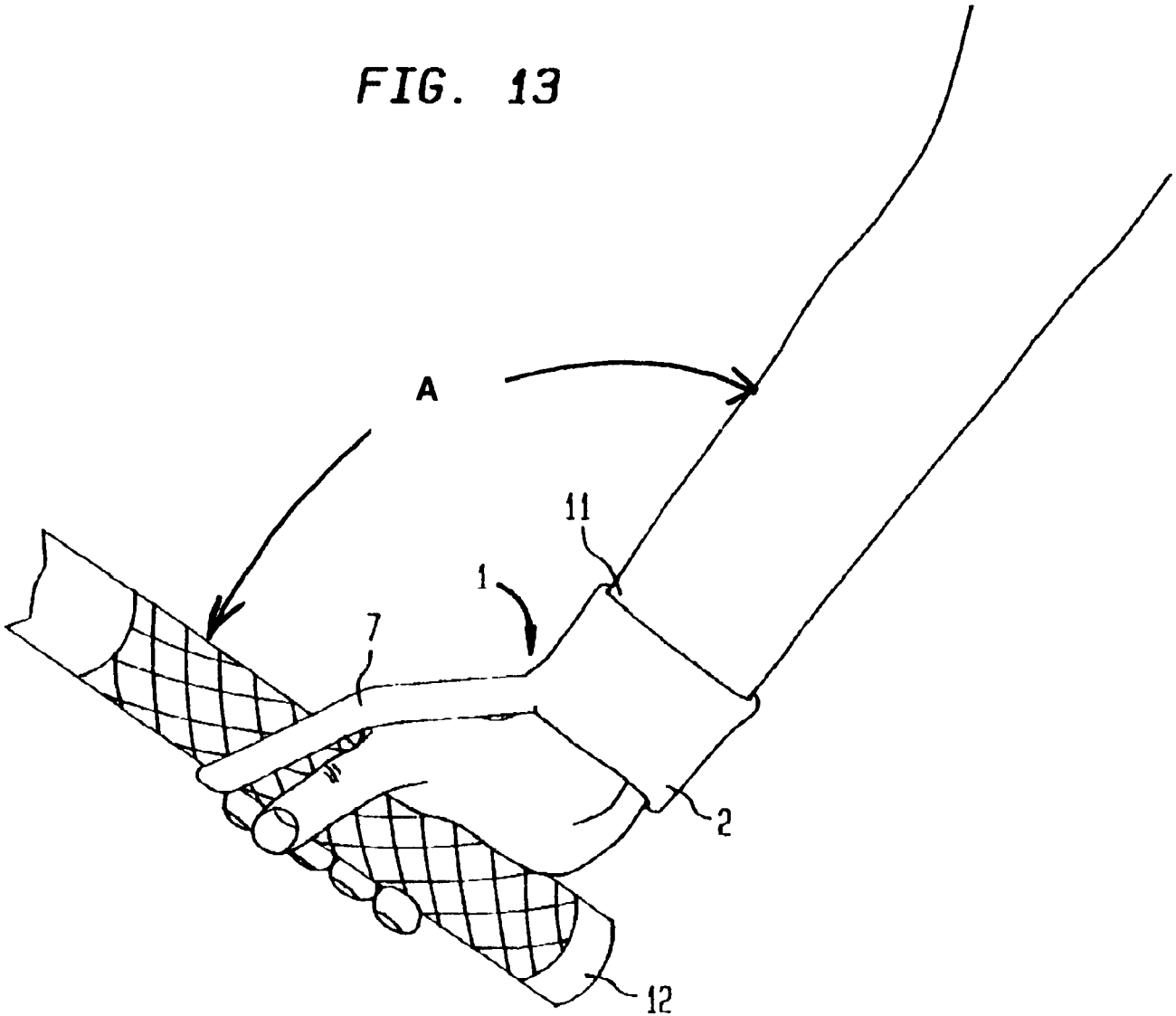
FIG. 13 is an isometric view of the racket gripping device of the present invention as attached around the user's wrist and gripping the racket handle.

FIG. 13 is an isometric view of racket gripping device 1 showing body 2 being securely wrapped around the user's wrist 11 and showing extension 7 gripping racket handle 12 via hole 8. Racket gripping device 1 positions the racket at an action angle "A" of from 90 degrees to 120 degrees relative to the user's wrist/forearm. Device 1 therefore a tennis player, pro or novice, in maintaining a proper grip on handle 12 of a tennis racket while playing. The material from which device 1 is made makes it possible for the user to grip a golf club, a racket, or bat, or other article without the application of substantial grip force, and the grip will be enhanced by the type of material from which body 2 and extension 7 are made. In addition, the material of body 2 protects the user's skin against chaffing resulting from contact with handle 12 and the consequent raising of blisters. Attaching the user's wrist 11 to body 2 in conjunction with extension 7 enables the user to exert additional force on the racket stroke. To use device 1, opposing ends 3 and 4 of body 2 are securely fastened around the user's wrist using cooperating fastening means 5 and 6 such as the hooks and loops of "Velcro" (trademark) fastening means. Handle 12 is then inserted through opening 8 of extension 7 and securely held therein while the user plays with the tennis racket.

Figure 14:
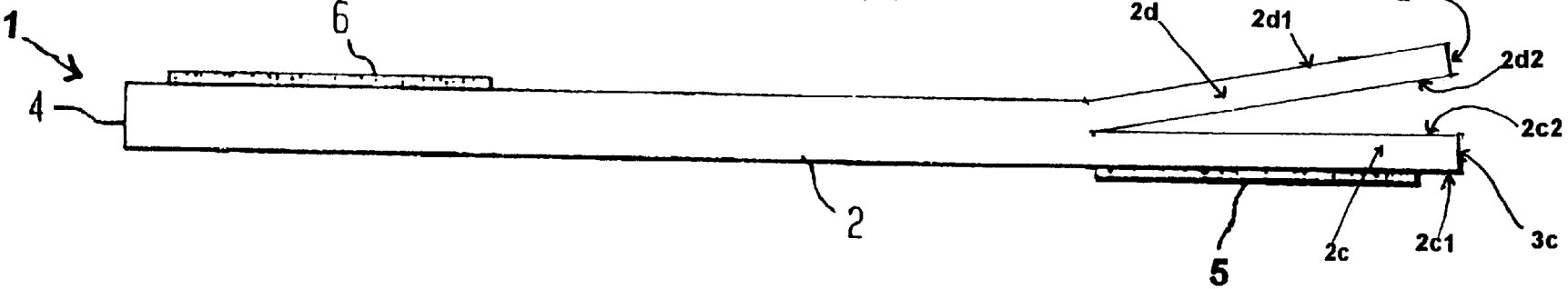
FIG. 14 is another bottom view of said second embodiment.

FIG. 14 is another bottom view of racket gripping device 1 showing layer 2*c* of body 2 and layer 2*d* of body 2 being separated from each other for illustrative purposes only. Layer 2*c* comprises outer surface 2*c*1, inner surface 2*c*2, end 3*c*, and fastening means 5 on outer surface 2*c*1. Layer 2*d* comprises outer surface 2*d*1, inner surface 2*d*2, and end 3*d*. It is understood that inner surface 2*c*2 of layer 2*c* and inner surface 2*d*2 of layer 2*d* are attached to each other when device 1 is assembled and in actual use.

Specific features of the present invention are that:

Body 2 may be formed of suitable material such as fabric, leather, or rubber or a combination of fabric, leather, or rubber;

Body 2 may be formed an oil and acid resistant material;

From FIG. 9, body 2 may be 1 to 4 inches in width from surface 2*a* to surface 2*b*; body 2 may be 5 to 12 inches in length from end 3 to end 4 enough to encircle the user's wrist and such that cooperating fastening means 5 and 6 may overlap each other for securing body 2 to the user's wrist;

Opposing ends 3 and 4 of body 2 are separable and include cooperating fastening means 5 and 6 so as to releasably secure opposing ends 3 and 4 to the user's wrist in an encircling relation therewith;

Cooperating fastening means 5 and 6 are lengthwise adjustable relative to each other to enable body or strap 2 to accommodate different sized wrists and/or to apply varying degrees of tension on a particular wrist;

A preferred form of cooperating fastening means 5 and 6 comprises the hooks and loops of "Velcro" (trademark) fastener means which provide the ability to apply varying degrees of tension on a particular wrist or to attach firmly around the particular thickness of various person's wrists;

Other suitable cooperating fastening means 5 and 6 could include hooks and latches, or buttons and holes;

Extension or racket gripping means 7 as viewed in FIGS. 1–7 can be stitched or otherwise suitably secured at connecting points 9 and 10 so that extension 7 extends perpendicularly from the center of body 2; extension 7 forming hole 8 of such size so as to accommodate and hold racket handle 12; extension 7 being preferably formed of elastic, extendable, or stretchable material that will enhance the grip on racket handle 12 or other racket device coming in contact therewith;

Extension or racket gripping means 7 as viewed in FIGS. 8–12 may be an integral part of body 2 and extends perpendicularly from the center of body 2;

Body 2 as shown in FIGS. 8–12 may be formed of one layer of material or a plurality of overlying contiguous layers attached to each other by adhesive means; the front surface 2*d* of body 2 shown in FIG. 10 may be a pad of cushioning material or fabric material such as terry cloth being interposed between body 2 and the user's wrist;

In FIG. 10, body 2 and extension 7 may include a layer 2*c* of elastic, extendable, stretchable material such as neoprene rubber with a thickness of from 2/16 inches to 4/16 inches and a layer 2*d* of fabric such as terry cloth;

In FIG. 9 extension 7 includes edges 7*a* and 7*b* sufficiently far apart to form hole 8 for accommodating racket handle 12;

In FIG. 9, the height of extension 7 from its first end at the level of edge 2*a* of body 2 to its second end at the level of edge 7*c* of extension 7 may be from 2 inches to 4 inches to accommodate the distance from the user's wrist to the position of handle 12 then the users hand is gripping handle 12;

Hole or aperture or opening 8 formed by extension 7 which is adapted to engage a racket handle may be provided with a coarse surface along its inner periphery 8*a* as shown in FIG. 9 to enhance handle gripping characteristics.

The tennis training device according to this invention may be used by persons engaging in athletic and other activities which requires one firmly grip such devices as tennis and squash rackets, bats, oars, hammers, brooms, or any other activity wherein it is desirable to enhance the grip a person may exert on an object or provide support for a person's hand and wrist.

The racket gripping device of the present invention is described and illustrated with reference to two preferred embodiments. Since numerous modifications and changes thereof may become readily apparent to those skilled in the art after reading this disclosure, it must be understood that I do not wish to limit the scope of my invention to the exact constructions shown and described above and/or as claimed by me below.

What is claimed is:

1. A sports training device for aiding a user in holding the handle of a racket with his hand at a proper angle with respect to the user's forearm, said device comprising:

a unitary structure further comprising a body member and a single (one) extension member; said body member and said single extension member forming a T-shaped structure and being made of a layer of elastic material;

said body member including a first end, a second end, a first surface, a second surface, and a center portion; the direction between said body member first end and said body member second end defining the longitudinal direction;

first fastening means being located on said body member first surface near said body member first end; second fastening means being located on said body member second surface near said body member second end; said first fastening means and said second fastening means being adapted to cooperate with each other for removably and snugly securing said body member around the user's wrist;

said single extension member including a first end and a second end, said extension member first end being located at said body member center portion; said single extension member being directed perpendicularly to said longitudinal direction; said single extension member height being defined as the distance between said extension member first end and said extension member second end; said single extension member width being perpendicular to said height; said extension member width being smaller than said extension member height; said single extension member including an opening being smaller than said extension member width and being located near said extension member second end for receiving and snugly securing the racket handle, said extension member second end being directed away from said body member center portion while said extension member receives and secures the racket handle.

2. The training device of claim 1 wherein said layer of elastic material is made of rubber material.

3. The training device of claim 2 wherein said rubber material is neoprene.

4. The training device of claim 1 wherein said first fastening means and said second fastening means are of the hook and loop type of fastening means.

5. The training device of claim 1 wherein said extension member opening includes an inner periphery, said inner periphery being coated with a coarse material.

6. A sports training device for aiding a user in holding the handle of a racket with his hand at a proper angle with respect to the user's forearm, said device comprising:

a unitary structure further comprising a body member and a single (one) extension member; said body member and said single extension member forming a T-shaped structure and both being made of a first layer of an elastic material and a second layer of a second material; said first layer being contiguous to said second layer; said first layer including a first surface and a second surface; said second layer including a first surface and a second surface; said first layer second surface and said second layer second surface being attached to each other;

said body member including a first end, a second end, and a center portion; the direction between said body member first end and said body member second end defining the longitudinal direction;

first fastening means being located on said first layer first surface near said body member first end; second fastening means being located on said second layer first surface near said body member second end; said first fastening means and said second fastening means being adapted to cooperate with each other for removably and snugly securing said body member around the user's wrist;

said single extension member including a first end and a second end, said extension member first end being located at said body member center portion; said single extension member being directed perpendicularly to said longitudinal direction; said single extension member height being defined as the distance between said extension member first end and said extension member second end; said single extension member width being perpendicular to said height; said extension member width being smaller than said extension member height; said single extension member including an opening being smaller than said extension member width and being located near said extension member second end for receiving and snugly securing the racket handle, said extension member second end being directed away from said body member center portion while said extension member receives and secures the racket handle.

7. The training device of claim 6 wherein said first layer is made of rubber material.

8. The training device of claim 7 wherein said rubber material is neoprene.

9. The training device of claim 6 wherein said first fastening means and said second fastening means are of the hook and loop type of fastening means.

10. The training device of claim 6 wherein said extension member opening includes an inner periphery, said inner periphery being coated with a coarse material.

11. The training device of claim 6 wherein said second layer is made of a fabric material.

12. The training device of claim 11 wherein said fabric material is terry cloth.

13. The training device of claim 6 wherein said first layer second surface and said second layer second surface are attached to each other by adhesive means.

* * * * *